US011142368B2

(12) United States Patent
Kehlenbeck

(10) Patent No.: US 11,142,368 B2
(45) Date of Patent: Oct. 12, 2021

(54) CONTAINER FOR RECEIVING A BEVERAGE

(71) Applicant: Christian Kehlenbeck, Schwanewede (DE)

(72) Inventor: Christian Kehlenbeck, Schwanewede (DE)

( * ) Notice: Subject to any disclaimer, the term of this patent is extended or adjusted under 35 U.S.C. 154(b) by 175 days.

(21) Appl. No.: 16/495,510

(22) PCT Filed: Mar. 13, 2018

(86) PCT No.: PCT/EP2018/000097

§ 371 (c)(1),
(2) Date: Sep. 19, 2019

(87) PCT Pub. No.: WO2018/171932

PCT Pub. Date: Sep. 27, 2018

(65) Prior Publication Data

US 2020/0095016 A1 Mar. 26, 2020

(30) Foreign Application Priority Data

Mar. 23, 2017 (DE) ..... 102017002777.3
May 30, 2017 (DE) ..... 102017005112.7

(51) Int. Cl.
*B65D 8/00* (2006.01)
*A45F 3/18* (2006.01)
(Continued)

(52) U.S. Cl.
CPC ..... *B65D 11/04* (2013.01); *A45F 3/18* (2013.01); *A47G 19/2266* (2013.01); *B65D 7/04* (2013.01); *B65D 13/02* (2013.01); *B65D 23/006* (2013.01)

(58) Field of Classification Search
CPC ..... B65D 11/04; B65D 11/02; B65D 7/04; B65D 7/02; B65D 13/02; B65D 23/006;
(Continued)

(56) References Cited

U.S. PATENT DOCUMENTS 1,267,176 A 5/1918 Britt
2,308,325 A * 1/1943 Binnington ..... B01L 3/508 222/478
(Continued)

FOREIGN PATENT DOCUMENTS

DE 8701786 U1 6/1987
DE 19743820 A1 4/1999
(Continued)

OTHER PUBLICATIONS

Deutsches Patent—Und Markenamt (German Patent and Trademark Office), Recherchbericht (search in a related application), Feb. 15, 2018.
(Continued)

*Primary Examiner* — Robert J Hicks
(74) *Attorney, Agent, or Firm* — Laurence P. Colton; Smith Tempel Blaha LLC

(57) ABSTRACT

For the carrying of beverages, it is known to fill the beverages into containers. Generally, the opening of the container is either suitable for drinking directly from the container or for filling the container with the beverage and cleaning said container. The invention therefore provides a container for receiving a beverage, which container is particularly easy to handle and is able to be effectively cleaned. This is achieved by virtue of the fact that an upper portion of a body of the container has at least a first opening and a second opening, which are respectively to be closed and opened by means of a cap.

20 Claims, 3 Drawing Sheets

(51) Int. Cl.
*A47G 19/22* (2006.01)
*B65D 13/02* (2006.01)
*B65D 23/00* (2006.01)

(58) Field of Classification Search
CPC ..... B65D 41/04; B65D 41/00; B65D 41/06; B65D 1/0246; B65D 1/023; A45F 3/18; A45F 3/16; A47G 19/2266; A47G 19/2205
USPC .... 215/44, 43, 365, 329, 316; 220/293, 288, 220/505, 503; 206/547; D9/524, 523
See application file for complete search history.

(56) References Cited

U.S. PATENT DOCUMENTS

| | | | | |
|---|---|---|---|---|
| 2,330,019 | A | 9/1943 | Preston | |
| 3,156,383 | A | 11/1964 | Meili | |
| 4,925,063 | A * | 5/1990 | Ali | B65D 1/023 215/216 |
| 5,295,609 | A | 3/1994 | Robbins | |
| 5,358,148 | A | 10/1994 | Hanifl | |
| 5,897,010 | A | 4/1999 | Soyka | |
| 8,141,732 | B2 * | 3/2012 | Bohen | B65D 47/0842 215/382 |
| 8,641,891 | B1 | 2/2014 | Crowder | |
| 2008/0210658 | A1 | 9/2008 | Jo | |
| 2015/0190557 | A1 | 7/2015 | Nobles | |

FOREIGN PATENT DOCUMENTS

| | | | |
|---|---|---|---|
| DE | 60313276 | T2 | 7/2007 |
| DE | 202009008770 | U1 | 10/2009 |
| DE | 102014101073 | B4 | 6/2016 |
| FR | 539204 | A | 6/1922 |
| FR | 1038319 | A | 9/1953 |
| FR | 2850088 | A1 | 7/2004 |
| KR | 2020090001138 | U | 2/2009 |

OTHER PUBLICATIONS

WIPO, International Search Report (in the priority application), Jul. 2, 2018.
WIPO, Written Opinion of the ISA (in the priority application).

* cited by examiner

CONTAINER FOR RECEIVING A BEVERAGE

CROSS REFERENCE TO RELATED APPLICATIONS

This application is the US National Phase of and claims the benefit of and priority on International Application No. PCT/EP2018/000097 having an international filing date of 13 Mar. 2018, which claims priority on German Patent Application No. 10 2017 002 777.3 having a filing date of 23 Mar. 2017 and German Patent Application No. 10 2017 005 112.7 having a filing date of 30 May 2017.

BACKGROUND OF THE INVENTION

Technical Field

The invention relates to a container for receiving a beverage comprising a hollow body, an upper portion, which has a reclosable opening, and a lower portion, which has a base. The invention further relates to an upper portion for a container for receiving a beverage, wherein the upper portion has at least one reclosable opening and is detachably connected to a lower portion of the container.

Prior Art

For the carrying of beverages into school, to kindergarten, to work, for sport, for a hike, to university or the like, it is known to fill the beverages into containers. A chosen quantity of the beverage, or else a mixture of diverse beverages or liquids, can here be filled.

In the vast majority of cases, these known containers consist of a cylindrical, hollow body having a base on which the container can be deposited and having an opening through which the beverage is both filled and removed. Generally, the openings are modeled on the dimensions of the opening of a normal mineral water bottle, since these are particularly well suited to being able to drink directly from the bottle. Even if such sized openings are particularly well suited to drinking directly from the bottle, they are too small for the filling of a liquid, so that, in the filling of the beverage, spilling of the beverage regularly ensues. In particular in the filling of sugar-containing beverages, this spilling is very disadvantageous, since the discharged liquid must immediately be thoroughly removed so that it does not lead to unwanted sticking, or even the attraction of creatures, such as, for instance, ants.

In addition, containers for receiving beverages, which have a larger opening and prove particularly suitable for the filling of beverages, are known. In order to be able to drink also from these larger openings, a drinking adapter is screwed onto this opening. This drinking adapter generally has a valve which can be closed and opened by pressing, pulling or turning. The cleaning of such drinking adapters is very laborious, however, and in most cases cannot be performed satisfactorily, so that residues of the beverage invariably remain in the valve. In particular in the case of perishable beverages, such as, for instance, milk or juices, this can also result in damage to health.

BRIEF SUMMARY OF THE INVENTION

The object of the invention is therefore to provide a container for receiving a beverage, and an upper portion for the container, which is particularly easy to handle and is able to be effectively cleaned.

A container for achieving this object is a container for receiving a beverage, comprising a hollow body, an upper portion, which has a reclosable opening, and a lower portion, which has a base, characterized in that the upper portion has at least a first opening and a second opening, which are respectively to be closed and opened by means of a cap. It is hence provided that an upper portion of the body has at least a first opening and a second opening, which are respectively to be closed and opened by means of a cap. The two openings can be dimensioned such that they fulfil various functions. In this way, the bottle is able, for instance, to be particularly well filled and cleaned and, equally, it is particularly easily possible to drink from it. Because a cap is respectively assigned to each opening, liquid can be removed or fed from both openings independently of the other opening. As a result of the at least two openings, the container proves to be usable in a particularly flexible manner.

In particular, it can further be provided that the diameter of the first opening is smaller than the diameter of the second opening, in particular that the diameter of the first opening corresponds to 10% to 90%, preferably 30% to 70%, or 50%, of the diameter of the second opening. In concrete terms, it can be provided that an external diameter of the first opening measures 2.3 cm and an internal diameter 1.8 cm, while the external diameter of the second opening amounts to 4.5 cm and the internal diameter 4.0 cm. As a result of this dimensioning of the two openings, the first opening, for instance, is particularly suitable for use as a drinking opening, and the second opening, by virtue of its larger diameter, as an opening for filling the container with beverages or ice cubes. By virtue of these two openings, in particular by virtue of a relatively large opening, the entire container is also able to be particularly thoroughly and easily cleaned.

In addition, it can be provided that the upper portion is configured as a first part, which can be detachably coupled together with a second part formed by the lower portion, preferably screwed, latched or plugged thereto, to form the body. Furthermore, it is conceivable that between the first and the second part is arranged a sealing means, such as, for instance, a sealing ring. The division of the body or container is particularly advantageous, in particular, for cleaning purposes, but also for the manufacture of these same.

A further illustrative embodiment can provide that the first part and the second part respectively have a thread, wherein the thread of the first part and the thread of the second part correspond with one another in such a way that the first part is able to be screwed tightly, in particular in a liquid-tight manner, to the second part. It can here be provided that the first part has an internal thread and the second part an external thread; or vice versa. Moreover, it is conceivable that the pitches of the threads differ at least slightly in order to establish a particularly reliable connection.

Preferably, it can additionally be provided according to the invention that the openings are respectively connected by a bottle neck, in particular in a communicating manner, to the body, wherein the bottle neck of the first opening is longer than the bottle neck of the second opening, or the bottle neck of the first opening is shorter than the bottle neck of the second opening, or the bottle necks are equal in length. Depending on the application for which the container is intended, the length of the bottle necks can vary. The bottle necks of the two openings shall be dimensioned, however, such that opening of the openings or unscrewing of the caps is possible, without the respectively other cap being in the way. The caps can here be screwed by a thread onto the bottle necks, or slipped over a lip encompassing the bottle neck.

In addition, it can particularly preferredly be provided that the bottle neck of the first opening is oriented parallel, or at an angle, preferably 45 degrees, to a longitudinal axis of the container, and the bottle neck of the second opening forms with the bottle neck of the first opening, in particular with the longitudinal axis of the container, an angle, preferably a 90 degrees angle. As a result of this orientation of the bottle necks, both drinking through the bottle neck of the first opening is particularly advantageous, and filling of the container through the bottle neck of the second opening, is particularly simple. It is also conceivable, however, that both bottle necks form an angle relative to the longitudinal axis of the container.

Another preferred illustrative embodiment can provide that the body and/or the bottle necks can be enclosed by a jacket made of a heat-insulating material, preferably chloroprene rubber, wherein the jacket has means, in particular a zip fastener, snap fasteners, magnets, VELCRO® fastenings or the like, in order to be able to at least partially open and close the jacket for application to the body and/or the bottle necks, and the jacket has at least one hole, preferably a row of holes, in order to check the fill height of the beverage. The jacket is configured such that it has a hole which, in term of its diameter, corresponds to the circumference of the bottle neck of the first opening or the first opening. For the application of the jacket, this hole is then slipped over the bottle neck of the first opening. For the purpose of enclosure, the means are next joined together in such a way that both the body and the bottle neck of the second opening, or the second opening, are embraced by the jacket. It is here conceivable that the base of the body is enclosed by the insulating material or remains free. This heat-insulating material serves not only to protect from heat loss or heat gain, but also serves as protection from mechanical shocks. Alternatively to the here stated neoprene, it is also conceivable that the jacket can be produced from a foamed plastic or a textile material. By means of the row of holes on the jacket, it is also possible, without having to remove the container from the jacket, to determine how much liquid or what quantity of beverage is still present in the container. As a result, on the one hand a constant removal of the container from the jacket, and a therewith associated heat loss or heat gain, is prevented.

In addition, it can be provided that at least the bottle neck of the first opening has at least one projection for the securement of a cap which, by means of a ring, can be secured to the bottle neck, and/or the body has at least one indicator means, in particular a marking, for the fill height of the beverage in the body. In this way, the marking can serve, for instance, to indicate a maximum fill height of the beverage in the container. If the beverage exceeds this maximum fill height, unwanted discharge of liquid when the container is opened, or, in the case of carbonated beverages, an explosive discharge of the liquid, can ensue. According to the invention, it can be provided that the caps are fixedly connected to the bottle necks via a ring. In order to ensure that, when the bottle is opened, the cap does not constantly have to be held in place, or that a quick loss of the cap is prevented, the ring is prevented by the projections from sliding off from the bottle neck. These projections can be integrally assigned to the container or to the bottle neck, or can be subsequently added in the form of a ring.

In particular, it constitutes another advantageous configuration that the body, in particular the lower part, has a receptacle, in particular a notch or indentation, in order to receive an element for temperature regulation, preferably cooling or warming. This receptacle can be positioned, for instance, in the middle of the body and is specifically dimensioned such that a cool pack or heat pack can be introduced. It is also conceivable that this receptacle is assigned to the base of the body. Because the receptacle extends into the inside of the body or container, the heat or the cooling energy of the element can be effectively delivered to the liquid surrounding the receptacle or to the beverage. As a result of this thermoelement, a beverage which is to be cooled can be cooled and a beverage which is to be heated can be heated. The thermoelement is prevented from falling out by the jacket, which likewise encloses the receptacle. In order to change the thermoelement, the jacket must therefore be removed from the container, or at least opened.

Preferably, it can additionally be provided that the receptacle is oriented parallel to the longitudinal axis of the container and has an elongate form and, on a top side and/or bottom side respectively, preferably a reservoir, in particular for the reception of condensation water. If, for the cooling of the beverage, a cooling pack is guided into the receptacle, condensation water develops in the receptacle. In order to ensure that this condensation water does not drip or flow into the face of the user of the container when drinking, reservoirs, which can serve at least partially and temporarily to receive the condensation water, are assigned to the receptacle. The orientation of the receptacle along the longitudinal axis of the container likewise proves advantageous, since a largest possible contact surface between the thermoelement and the receptacle or beverage can thereby be realized.

Furthermore, it can be provided according to the invention that the body has at least one recess for an ergonomic handle and/or in order to grasp from the receptacle the element for temperature regulation.

Finally, it can be provided that the body, the first part, the second part and/or the bottle necks are produced from glass, metal, tritane or some other plastic. Glass, in particular, is particularly well suited, since it is transparent and is able to be cleaned particularly effectively. The casing of the container, measured from the base to the topmost cap, amounts to 10 cm to 30 cm, preferably 15 cm to 18 cm, in particular 19 cm. The diameter of the container amounts to 5 cm to 12 cm, preferably 6 cm to 10 cm, in particular 7 cm. The ratio of the height of the container to the diameter can vary, in particular can lie between 3 to 1 and 2 to 1.

An upper portion of the container for the achievement of the object stated in the introduction has at least one reclosable opening and is detachably connected to a lower portion of the container, characterized in that the upper portion has at least a first opening and a second opening, which are respectively to be closed and opened by means of a cap. It is hence provided that the upper portion has at least a first opening and a second opening, which are respectively to be closed and opened by means of a cap. Further advantageous illustrative embodiments of the invention are disclosed and claimed herein.

BRIEF DESCRIPTION OF THE DRAWINGS

Preferred illustrative embodiments of the invention are explained in greater detail below with reference to the drawing, in which.

DETAILED DESCRIPTION OF PREFERRED EMBODIMENTS

Figure 1:
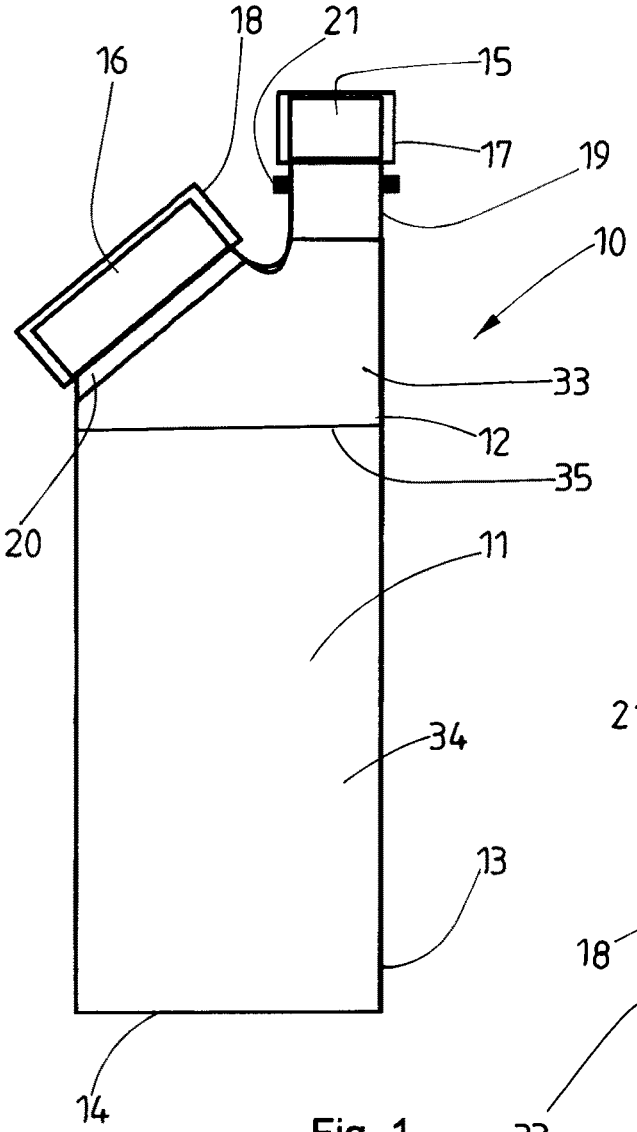
FIG. 1 shows a schematic side view of a container.

The container 10 according to the invention for receiving a beverage has a hollow body 11, which serves as a receiving volume for the beverage and has an upper portion 12 and a lower portion 13. The lower portion 13 has a base 14, which, in that illustrative embodiment of the container 10 according to the invention that is represented in FIG. 1, is of flat configuration, so that the container 10 can be deposited securely on this base 14.

An illustrative embodiment of the invention provides that the upper portion 12 is formed by a first part 33, and the lower portion 13 by a second portion 34. The first and the second part 33, 34 together form the body 11. The two parts 33, 34 can be coupled with one another, for instance, by a thread 35 shown in schematized representation in the figures. Both the first part 33 and the second part 34 here have threads, which correspond with one another. It is also conceivable, however, that the parts 33, 34 are able to be coupled to one another in some other way.

To the upper portion 12 of the container 10 or of the body 11 are assigned, according to the invention, a first opening 15 and a second opening 16. In the illustrative embodiment represented in FIG. 1, the two round openings 15, 16 are covered by respectively a cap 17, 18. By this cap 17, 18, the openings 15, 16 are able to be closed off and re-opened. To this end, it is provided that the container 10 has threads (not represented), which correspond with corresponding threads of the caps 17, 18. It is also conceivable, however, that the caps 17, 18 are pressed onto corresponding counterparts of the container 10, so that a liquid-tight or gas-tight connection between the caps 17, 18 and the container 10 can be established. The thread 35 for connecting the first part 33 to the second part 34 is arranged directly beneath the second opening 16. It is also conceivable, however, that the thread 35 bisects the body 11, or that the thread 35 is rather located close to the base 14.

In the illustrative embodiments which are here represented, the openings 15, 16 are respectively connected to the body 11 via a bottle neck 19, 20. Depending on the field of application and dimensioning of the container 10, these bottle necks 19, 20 can be configured differently long. Advantageously, it is provided that the bottle neck 20 is configured shorter than the bottle neck 19. The second opening 16, due to its larger diameter, serves for the filling of the container 10 with a liquid or with a beverage. Equally, this opening 16 proves particularly advantageous for the cleaning of the container 10. The, in terms of its diameter, smaller opening 15 is particularly well suited to drinking, since the diameter of the opening 15 corresponds to that of an opening of a mineral water bottle. It is also conceivable, however, that the two openings 15, 16 have another size or another size ratio.

In order to ensure that the caps 17, 18 do not get lost when the container 10 is opened, in the illustrative embodiment which is here represented it is provided that at least the bottle neck 19 has projections 21. A ring connected to the cap 17 can be slipped over these projections 21 and thus prevents loss of the cap. Alternatively, it can be provided that the projections 21 are configured as a lip-like bead, which bead extends around the bottle neck 19.

While the bottle neck 19 is oriented parallel to a longitudinal axis of the container 10, the bottle neck 20 of the second opening 16 forms with the bottle neck 19 or with the longitudinal axis of the container an acute angle. This different orientation of the bottle necks 19, 20 or of the openings 15, 16 proves particularly advantageous for the filling of the container 10 through the second opening 16 and for drinking through the first opening 15. However, it can also be provided that the bottle necks 19, 20 are oriented differently. Thus it is also provided, for instance, that the bottle neck 19 and the bottle neck 20 form a right angle, wherein the bottle neck 19 forms with the longitudinal axis of the container 10 an angle of 45 degrees.

Figure 2:
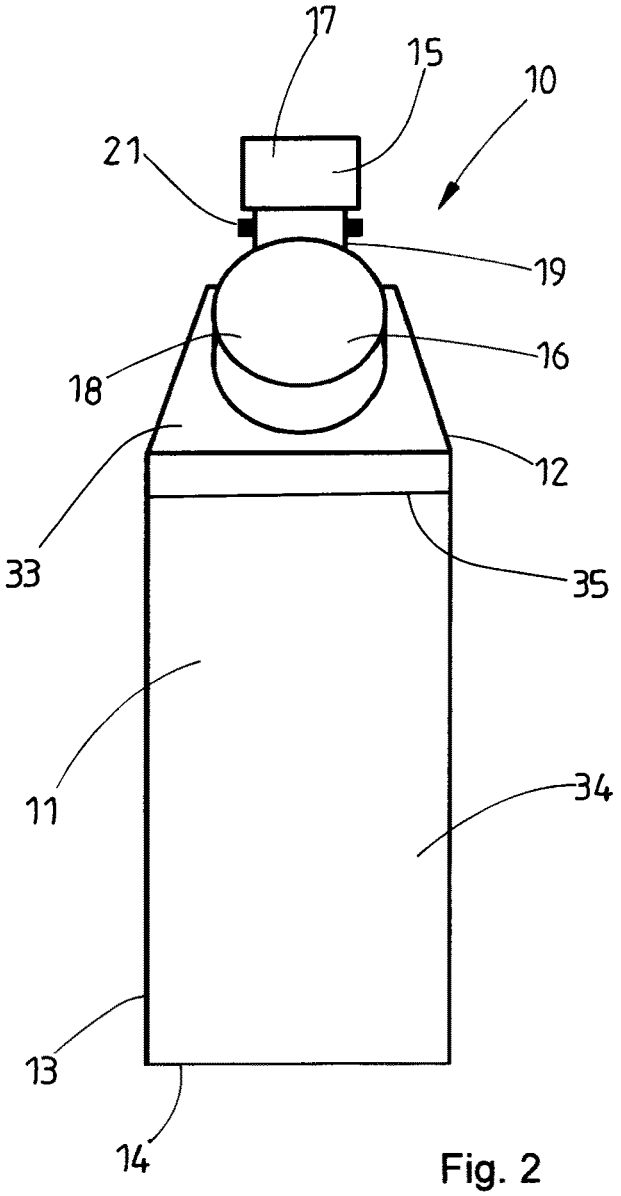
FIG. 2 shows a further side view of the container according to FIG. 1.

The upper portion 12 of the container 10 is tapered in relation to the lower portion 13. This serves, on the one hand, to make the entire container more stable and, on the other hand, to ensure that an outer diameter of the container 10, despite the openings 15, 16, does not become too large (FIG. 2).

Figure 3:
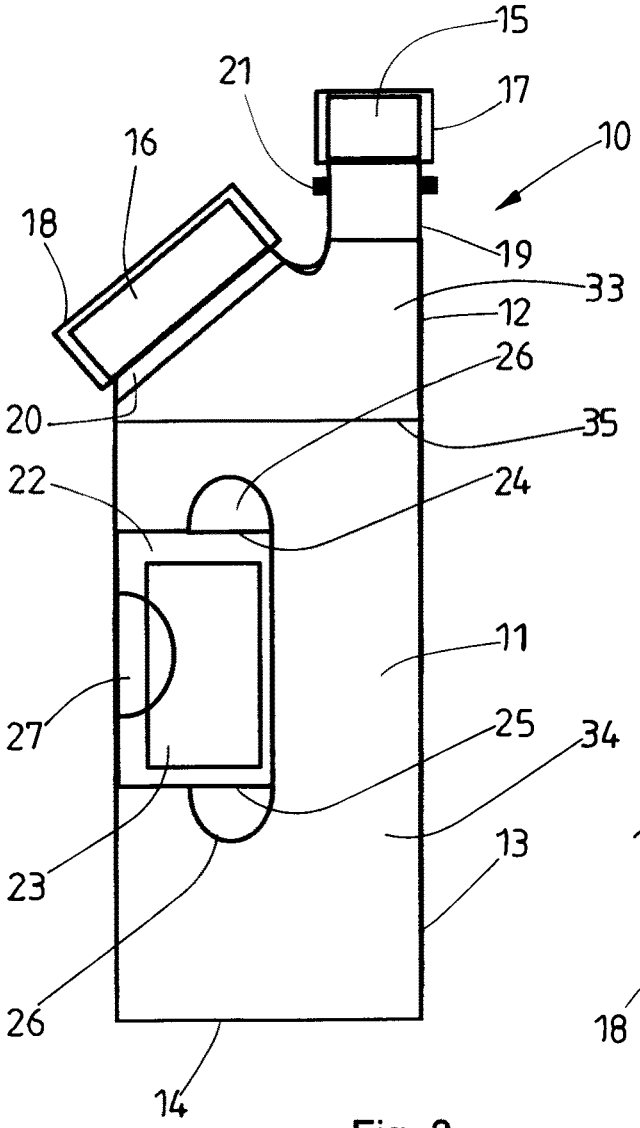
FIG. 3 shows a schematic side view of a further illustrative embodiment of the container according to the invention.
Figure 4:
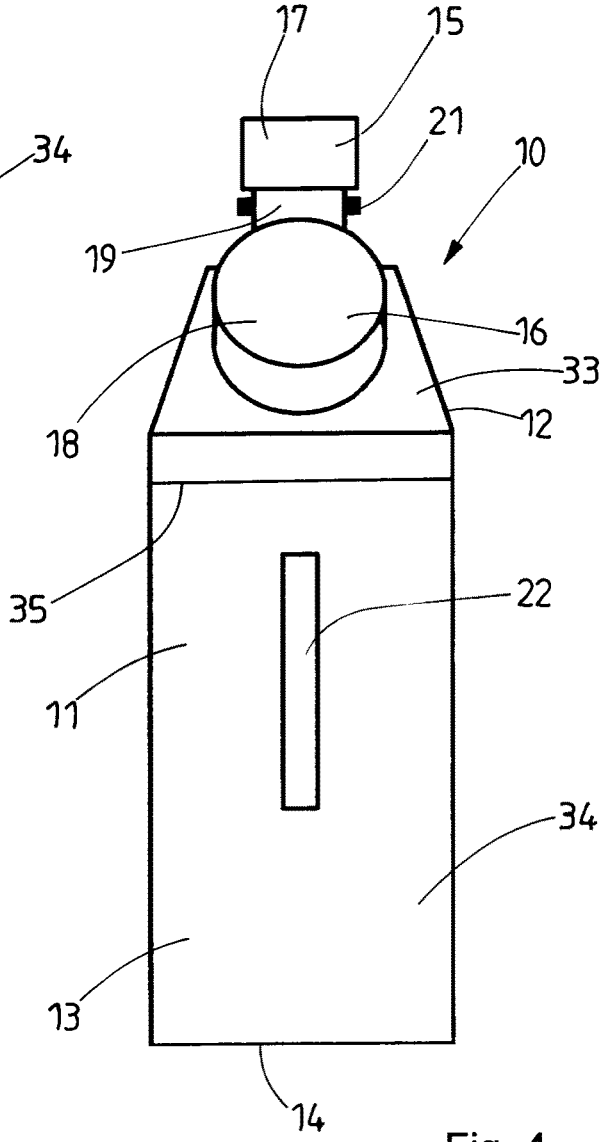
FIG. 4 shows a further side view of the container according to FIG. 3.

A further illustrative embodiment of the present container 10 can provide that the body 11 has a receptacle 22. This receptacle serves to receive an element 23 for regulating the temperature of the beverage. For instance, this element 23 can have a cooling or warming effect. In the illustrative embodiment represented in FIGS. 3 and 4, the receptacle 22 is arranged in the middle of the body 11 and extends parallel to the longitudinal axis of the container 10. The receptacle 22 is of cuboid configuration, so that it can receive the likewise cuboid element 23. On a top side 24 and a bottom side 25, the receptacle 22 respectively has a reservoir 26. This reservoir serves to receive condensation water which is formed, in particular, during the cooling of the beverage. When the container 10, for drinking, is tilted out of its vertical position, the condensation water collects in the reservoirs 26 and does not flow into the face of the person wishing to take refreshment.

In order to ensure that the element 23 can be easily removed from the receptacle 22, the body 12 has a recess 27. This recess 27 enables the element 23 to be able to reached at least by a finger and to be pulled out of the receptacle 22. Equally, it is conceivable that an element 23 for regulating the temperature of the beverage can be introduced into a receptacle on the base 14 of the container 10.

Figure 5:
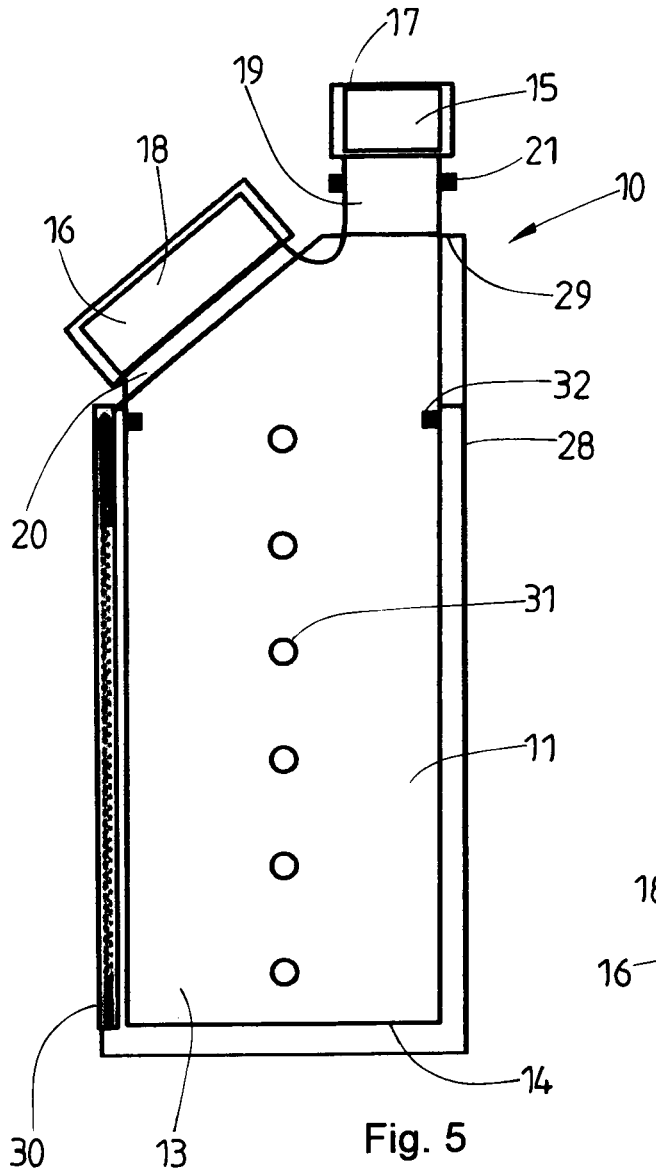
FIG. 5 shows a schematic side view of a container having a jacket.

In order to thermally insulate the container 10 and protect it from mechanical shocks, it is provided according to the invention to enclose the container 10 by means of a jacket 28. In that illustrative embodiment of the jacket 28 that is represented in FIG. 5, this same is represented "transparent" for viewing purposes in order to illustrate the position of the container 10 in the jacket 28. It is provided, however, that this jacket 28 does not have to be transparent, but rather, for appropriate applications, can be printed on. Thus the jacket 28 is able to be printed, for instance, with children's motifs, animals, landscapes or the like.

Figure 6:
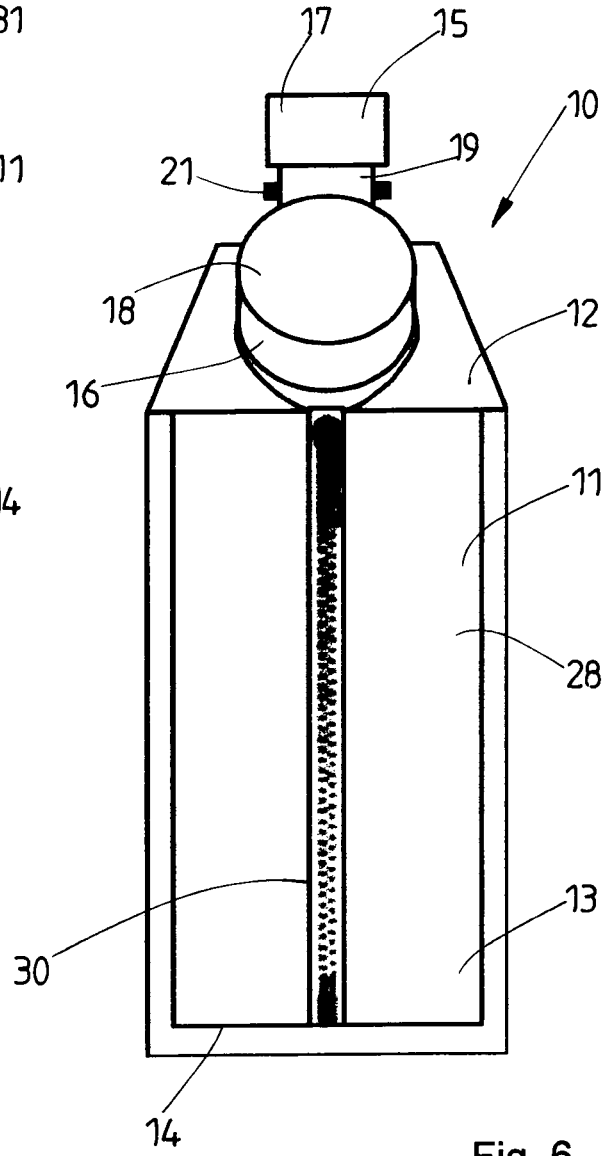
FIG. 6 shows a further side view of the container having a jacket, according to FIG. 5.

For a particularly effective thermal protection, the jacket 28 is preferably formed of neoprene, yet can also be produced from another material. The jacket 28 has in an upper region an opening 29, through which, when the jacket 28 is applied to the container 10, the first opening 15 can be passed. In addition, the jacket 28 has at least one means for closure of this same. In the illustrative embodiment represented in FIGS. 5 and 6, a zip fastener 30 is assigned to the jacket 28. Alternatively, in place of the zip fastener 30, also a row of snap fasteners, a VELCRO® fastening or the like can serve for the closure. After the opening 29 has been slipped over the bottle neck 19, the jacket 28, by closure of the zip fastener 30, is closed around the container 10, to be precise in a way in which the second opening 16 or the bottle neck 20 still pokes out of the jacket 28.

The jacket 28 can be configured such that it likewise surrounds the base 14. It is also conceivable, however, that the base 14 is exposed. In order also to be able to determine the fill level of the container 10 in the enclosed state, the jacket 28 can have a row of holes 31, which open up the view into the inside of the body 10.

FIG. 5 further shows a fill level indicator 32, which can be configured as a projection and indicates, for instance, the maximum fill height. It is also conceivable, however, that such indicators 32 provide information about the residual liquid in the container 10.

The jacket 28 additionally means that the element 23 for regulating the temperature of the beverage cannot inadvertently slide out of the receptacle 22. In the enclosed state, the jacket 28 specifically prevents the element 23 from falling out of the receptacle 22.

REFERENCE SYMBOL LIST

10 container
11 body
12 upper portion
13 lower portion
14 base
15 first opening
16 second opening
17 cap
18 cap
19 bottle neck
20 bottle neck
21 projection
22 receptacle
23 element
24 top side
25 bottom side
26 reservoir
27 recess
28 jacket
29 opening
30 zip fastener
31 hole
32 indicator
33 first part
34 second part
35 thread

The invention claimed is:

1. A container (10) for receiving a beverage, comprising a hollow body (11), an upper portion (12), which has a reclosable opening, and a lower portion (13), which has a base (14), wherein the upper portion (12) has at least a first opening (15) and a second opening (16), which are respectively to be closed and opened by means of a cap (17, 18), and wherein the upper portion (12) is configured as a first part (33), which can be detachably coupled together with a second part (34) formed by the lower portion (13), to form the body (11), wherein the first part (33) can be detachably screwed, latched, or plugged together with the second part (34) to form the body (11), wherein the first part (33) and the second part (34) respectively have a thread, wherein the thread of the first part (33) and the thread of the second part (34) correspond with one another in such a way that the first part (33) is able to be screwed tightly to the second part (34), wherein the first opening (15) has a diameter that is smaller than a diameter of the second opening (16), wherein the first opening (15) serves as a drinking opening, and the second opening (16), by virtue of its larger diameter, serves as an opening for filling the container (10) with beverages or ice cubes, wherein the openings (15, 16) are respectively connected by a bottle neck (19, 20) in a communicating manner to the body (11), and wherein the bottle neck (19) of the first opening (15) is oriented parallel, or at an angle, to a longitudinal axis of the container (10), and the bottle neck (20) of the second opening (16) forms an angle with the longitudinal axis of the container (10), whereby both drinking from the container through the bottle neck (19) of the first opening (15) is advantageous and filling of the container (10) through the bottle neck (20) of the second opening (16) is simple.

2. The container (10) for receiving a beverage as claimed in claim 1, wherein the diameter of the first opening (15) is 10% to 90% of the diameter of the second opening (16).

3. The container (10) for receiving a beverage as claimed in claim 1, wherein the first part (33) is able to be screwed tightly in a liquid-tight manner, to the second part (34).

4. The container (10) for receiving a beverage as claimed in claim 1, wherein the bottle neck (19) of the first opening (15) is longer than the bottle neck (20) of the second opening (16).

5. The container (10) for receiving a beverage as claimed in claim 4, wherein the bottle neck (19) of the first opening (15) is oriented at an angle of 45 degrees to the longitudinal axis of the container (10), and the bottle neck (20) of the second opening (16) forms an angle of 90 degrees with the longitudinal axis of the container (10).

6. The container (10) for receiving a beverage as claimed in claim 4, wherein at least the bottle neck (19) of the first opening (15) has at least one projection (21) for the securement of a cap (17) which, by means of a ring, can be secured to the bottle neck (19), and/or the body (11) has at least one indicator means (32) for indicating a fill height of the beverage in the body (11).

7. The container (10) for receiving a beverage as claimed in claim 4, wherein the body (11), the first part (33), the second part (34) and/or the bottle necks (19, 20) are produced from glass, metal, tritane or some other plastic.

8. The container (10) for receiving a beverage as claimed in claim 1, wherein the bottle neck (19) of the first opening (15) is shorter than the bottle neck (20) of the second opening (16).

9. The container (10) for receiving a beverage as claimed in claim 1, wherein the bottle necks (19, 20) are equal in length.

10. The container (10) for receiving a beverage as claimed in claim 1, wherein the diameter of the first opening (15) is 30% to 70% of the diameter of the second opening (16).

11. An upper portion (12) for a container (10) for receiving a beverage, wherein the upper portion (12) has at least one reclosable opening and is detachably connected to a lower portion (13) of the container (10), wherein the upper portion (12) has at least a first opening (15) and a second opening (16), which are respectively to be closed and opened by means of a cap (17, 18), wherein the first opening (15) has a diameter that is smaller than a diameter of the second opening (16), wherein the first opening (15) serves as a drinking opening, and the second opening (16), by virtue of its larger diameter, serves as an opening for filling the container (10) with beverages or ice cubes, wherein the openings (15, 16) are respectively connected by a bottle neck (19, 20) in a communicating manner to the body (11), and wherein the bottle neck (19) of the first opening (15) is oriented parallel, or at an angle, to a longitudinal axis of the container (10), and the bottle neck (20) of the second opening (16) forms an angle with the longitudinal axis of the container (10), whereby both drinking from the container through the bottle neck (19) of the first opening (15) is advantageous and filling of the container (10) through the bottle neck (20) of the second opening (16) is simple.

12. The upper portion (12) as claimed in claim 11, wherein the diameter of the first opening (15) amounts to 10% to 90% of the diameter of the second opening (16).

13. The upper portion (12) as claimed in claim 11, wherein the upper portion (12) has a thread, by which it can be screwed in a liquid-tight manner to the lower portion (13).

14. The upper portion (12) as claimed in claim 11, wherein the bottle neck (19) of the first opening (15) is longer than the bottle neck (20) of the second opening (16).

15. The upper portion (12) as claimed in claim 14, wherein the bottle neck (19) of the first opening (15) is oriented at an angle of 45 degrees to the longitudinal axis of the container (10), and the bottle neck (20) of the second opening (16) forms an angle of 90 degrees with the longitudinal axis of the container (10).

16. The upper portion (12) as claimed in claim 14, wherein at least the bottle neck (19) of the first opening (15) has at least one projection (21) for the securement of the cap (17), which, by means of a ring, can be secured to the bottle neck (19).

17. The upper portion (12) as claimed in claim 11, wherein the upper portion (12) is produced from glass, metal, tritane or some other plastic.

18. The upper portion (12) as claimed in claim 11, wherein the bottle neck (19) of the first opening (15) is shorter than the bottle neck (20) of the second opening (16).

19. The upper portion (12) as claimed in claim 11, wherein the bottle necks (19, 20) are equal in length.

20. The upper portion (12) as claimed in claim 11, wherein the diameter of the first opening (15) is 30% to 70% of the diameter of the second opening (16).

* * * * *